United States Patent [19]

Hayashi

[11] Patent Number: 4,664,055

[45] Date of Patent: May 12, 1987

[54] ALARM HORN

[75] Inventor: Takatoshi Hayashi, Kohnosu, Japan

[73] Assignee: Kobishi Electric Co., Ltd., Tokyo, Japan

[21] Appl. No.: 700,638

[22] Filed: Feb. 12, 1985

[30] Foreign Application Priority Data

Feb. 21, 1984 [JP] Japan ..... 59-23253[U]
Nov. 14, 1984 [JP] Japan ..... 59-172773[U]

[51] Int. Cl.[4] ..... G08B 3/00; G10K 9/00

[52] U.S. Cl. ..... 116/142 R; 340/388; 340/571

[58] Field of Search ..... 116/137 R, 142 R, 142 FP, 116/142 FV; 200/52 R, 61.79, 61.93, 85 R; 340/388, 571

[56] References Cited

U.S. PATENT DOCUMENTS 1,132,154 3/1915 Bliley ..... 200/85 R
1,171,042 2/1916 Greytak ..... 200/85 R
2,386,513 10/1945 Soderberg ..... 116/137 R
3,858,193 12/1974 Bach ..... 340/575
4,092,641 5/1978 Bellinghausen ..... 340/571
4,171,677 10/1979 Hibell ..... 116/137 R
4,310,833 1/1982 Sakaguchi ..... 340/388

*Primary Examiner*—Richard R. Stearns
*Attorney, Agent, or Firm*—Scully, Scott, Murphy & Presser

[57] ABSTRACT

An alarm horn includes a one-piece molded body which includes a casing portion having opposite open ends, and a first horn disposed in the casing portion and having opposite open ends. The first horn is connected to the casing portion at their one ends. A second horn of a generally cup-shape is disposed in the first horn in spaced relation thereto. Connective portions extend between the first and second horns to connect them together. A sound-generating unit is disposed in the casing and is fixedly connected to the other end of the first horn.

5 Claims, 5 Drawing Figures

ALARM HORN

BACKGROUND OF THE INVENTION

1. Field of the Invention

This invention relates to an alarm horn such as a fire alarm or a burglar alarm.

2. Prior Art

One conventional alarm horn 10 shown in FIG. 1 comprises a casing 12 of cast aluminum or a molded synthetic resin having an end wall 12*a* and an open end 12*b*, a sound-generating unit 14 mounted within the casing 12 and having a first horn 14*a*, a second horn 16 secured to a base 14*b* of the sound-generating unit 14 by screws 13 in enclosing relation to the first horn 14*a*, and a third horn 18 engaged with the base 14*b* and an inner peripheral surface of the casing 12 at opposite ends thereof, the third horn 18 being secured to the base 14*b* by screws 15. The sound-generating unit 14 is in the form of a dynamic loudspeaker. The end wall 12*a* of the casing 12 has a plurality of apertures 12*b* therethrough for transmitting the sound, generated by the sound-generating unit 14, to the exterior of the casing 12. A lid 17 is attached to the open end 12*b* of the casing 12, and the base 14*b* of the sound-generating unit 14 is secured to the lid 17 by screws 19. Thus, the sound-generating unit 14, the second and third horns 16 and 18 and the casing 12 are fixed with respect to one another by screws 13, 15 and 19. With this construction, the conventional alarm horn 10 has often suffered from the disadvantage that unless the component parts are connected together firmly to provide a sufficient strength, the alarm horn 10 is subjected to damage when subjected to severe external forces. In addition, the assembly of the conventional alarm horn 10 requires much time and labor because of the use of such separate component parts.

SUMMARY OF THE INVENTION

It is therefore an object of this invention to provide an alarm horn of the type which has an increased mechanical strength and can be assembled easily and quickly.

According to the present invention, there is provide an alarm horn which comprises:

(a) a one-piece molded body including (i) a casing portion having opposite open ends, (ii) a first horn disposed in the casing portion and having opposite open ends, the first horn being connected to the casing portion at their one ends, (iii) a second horn of a generally cup-shape disposed in the first horn in spaced relation thereto, and (iv) connective means extending between the first and second horns to connect them together; and (b) a sound-generating unit disposed in the casing and fixedly connected to the other end of the first horn.

DESCRIPTION OF THE PREFERRED EMBODIMENTS OF THE INVENTION

Figure 1:
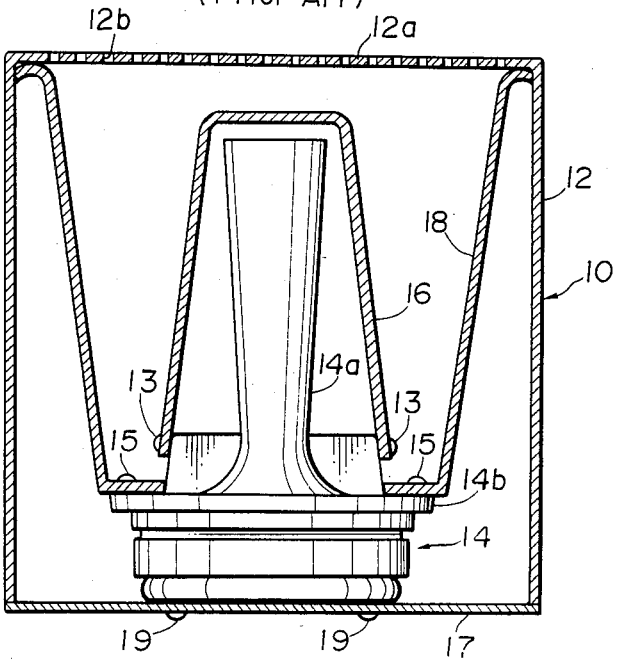
FIG. 1 (Prior Art)
FIG. 1 is a cross-sectional view of a conventional alarm horn.

Like reference numerals denote corresponding parts in several views.

Figure 2:
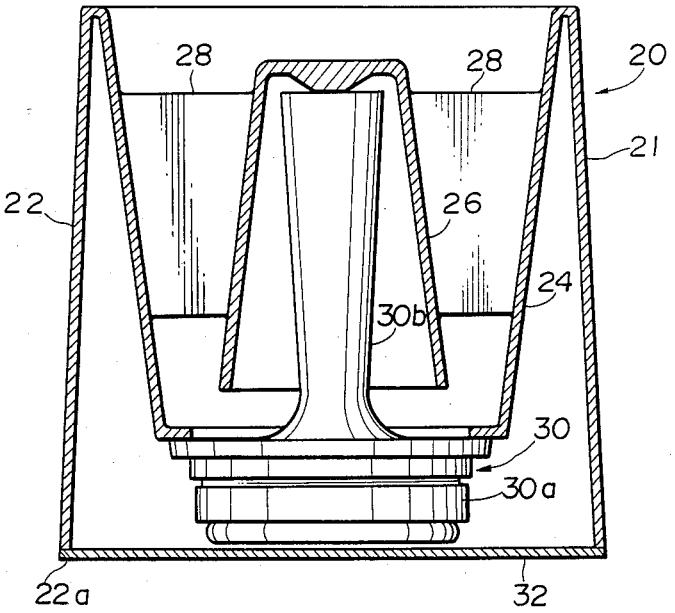
FIG. 2 is a cross-sectional view of an alarm horn provided in accordance with the present invention.

An alarm horn 20 shown in FIG. 2 comprises a one-piece molded body 21 of cast aluminum which includes a casing portion 22 of a square cross-section having opposite open ends, an outer horn 24 of a circular cross-section disposed in the casing portion 22 in coaxial relation thereto and having opposite open ends one of which is connected to one end of the casing portion 22, and a cup-shaped intermediate horn 26 of a circular cross-section disposed in the outer horn 24 in coaxial and radially spaced relation thereto. The outer and intermediate horns 24 and 26 are connected together by four connective portions 28 extending therebetween in equally circumferentially spaced relation, the connective portions 28 being in the form of a plate and disposed along the axis of the body 21. A sound-generating unit 30 in the form of a dynamic loudspeaker is mounted within the casing portion 22, and includes a base 30*a* and an inner horn 30*b* extending from the base 30*a* into the intermediate horn 26. The open end of the outer horn 24 remote from the one end of the casing portion 22 is secured to the base 30*a* of the sound-generating unit 30 by suitable fastening means such as screws or an adhesive. A lid 32 is removably attached to the other end 22*a* of the casing portion 22 by screws (not shown). The one-piece body 21 may be made of a molded synthetic resin For assembling the alarm horn 20, the sound-generating unit 30 is first placed in position in the casing portion 22. Then, the lid 32 is attached to the end 22*a* of the casing portion 22. Thus, since the casing portion 22, the outer horn 24 and the intermediate horn 26 are formed integrally to provide a unitary construction, the alarm horn 20 can be assembled quite easily and quickly. And, this unitary construction provides for an increased mechanical strength of the body 21 because of less separate component parts.

Figure 3:
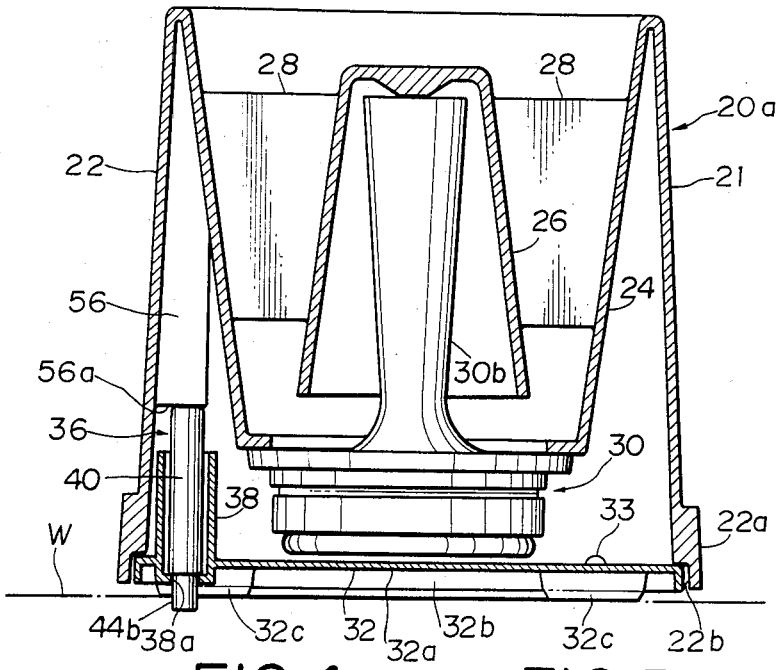
FIG. 3 is a view similar to FIG. 2 but showing a modified alarm horn incorporating a tamper switch.

FIG. 3 shows a modified alarm horn or burglar alarm 20*a* which differs from the alarm horn 20 of FIG. 2 in that a tamper switch 36 is provided for detecting the removal of the alarm horn 20*a* from a wall W by an unauthorized person. The tamper switch 36 is electrically connected to the sound-generating unit 30 for activating it to produce a sound as hereinafter more fully described.

The other ends 22*a* of the casing portion 22 is thickened and has an inner peripheral recess 22*b*. A lid 32 comprises a square plate 32*a* having a peripheral wall 32*b* and is received in the recess 22*b*. A plurality of bosses 32*c* are formed on the outer surface of the plate 32*a*, and the bosses 32*c* having respective threaded bores for threadedly receiving screws 33 for attaching the lid 32 to the wall W.

Figure 4:
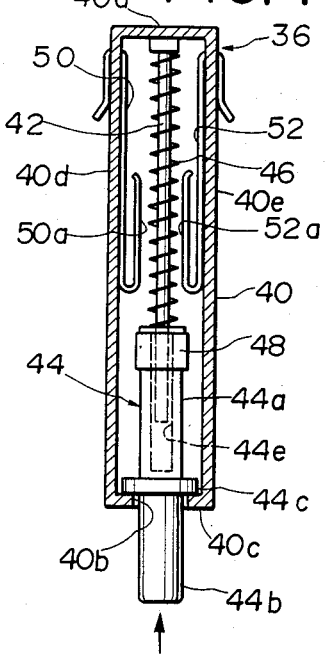
FIG. 4 is a cross-sectional view of the tamper switch.

The lid 32 has a tubular portion 38 of a square cross-section extending through the plate 32*a* perpendicularly thereto along the axis of a body 21, the tubular portion 38 having an aperture 38*a* formed in an outer end wall thereof. As best shown in FIG. 4, the tamper switch 36 comprises a hollow housing 40 of a square cross-section slidably received in the tubular portion 38 for sliding movement therealong. A guide rod 42 is disposed in the housing 40 in coaxial relation thereto with one end thereof fixedly secured to an inner end wall 40*a* of the housing 40. A switch-operating plunger 44 is received in the housing 40 for movement along the axis thereof, and includes an inner cylindrical portion 44*a*, an outer portion 44*b* of a square cross-section disposed in coaxial relation to the inner portion 44*a*, and an intermediate collar portion 44*c* disposed between the inner and outer portions 44*a* and 44*b*. The outer portion 44*b* of the plunger 44 slidably extends through a square aperture 40*b* formed in an outer end wall 40*c* of the housing 40 and also extends slidably through the aperture 38*a* of the tubular portion 38. The inner portion 44*a* has an axial bore 44*e* opening to an inner end of the plunger 44 remote from the outer portion 44*b*. One end portion of the guide rod 42 remote from the inner end wall 40*a* of the housing 40 is slidably received in the axial bore 44*d*. A compression coil spring 46 is wound around the guide rod 42 and acts between the inner end wall 40*a* of the housing 40 and the inner end of the inner portion 44*a* to urge the collar 44*c* into contact with the outer end wall 40*c* of the housing 40. A contact element 48 of an electrically-conductive material in the form of a tube is fitted on the inner end of the inner portion 44*a* of the plunger 44. A pair of contact plates 50 and 52 of an electrically-conductive material are laid against inner surfaces of opposed side walls 40*d* and 40*e* of the housing 40 with their one ends extending respectively through the side walls 40*d* and 40*e* adjacent to the outer end wall 40*a* of the housing 40 and bent against the outer surfaces of the side walls 40*d* and 40*e* to fix the contact plates 50 and 52 relative to the housing 40. Inner end portions of the contact plates 50 and 52 are bent over to provide a pair of resiliently-deformable opposed contact portions 50*a* and 52*a*. The outer ends of the contact plates 50 and 52 disposed exteriorly of the housing 40 serves as terminals. These terminals and the sound-generating unit 14 are electrically connected to a control system (not shown) so that when the tamper switch 36 is deactivated as shown in FIG. 4, the sound-generating unit 14 is activated to produce an alarm sound. As shown in FIG. 3, an elongated projection or abutment 56 is formed integrally on the inner surface of the casing portion 22 and disposed in registry with the tamper switch 36, the projection 56 having one end 56*a* held in engagement with the inner end of the housing 40 of the tamper switch 36 for limiting the axial inward movement of the housing 40.

For installing the alarm horn 20*a*, the lid 32 is first attached by the screws 33 to the wall W indicated by a dot and dash line in FIG. 3. Then, the tamper switch 36 is received in the tubular portion 38 of the lid 32. Then, the body 21, to which the sound-generating unit 30 is attached, is attached to the lid 32 by screws (not shown) so that the end 56*a* of the projection 56 is engaged with the inner end of the housing 40 of the tamper switch 38 to urge the plunger 44, disposed in contact with the wall W at its outer end, inwardly against the bias of the coil spring 46, thereby bringing the contact element 48 into electrical contact with the contact plates 50 and 52 to hold the tamper switch 36 in its activated condition. The alarm horn 20*a* is so arranged that when the tamper switch 36 is deactivated as shown in FIG. 4, the sound-generating unit 14 is activated through the control system to produce an alarm sound.

When an unauthorized person such as a burglar removes from the wall W the whole of the alarm horn 20*a* including the lid 32, the plunger 44 is axially moved relative to the housing 40 away from the abutment 56 under the influence of the coil spring 46 to bring the contact element 48 out of engagement with the contact plates 50 and 52 to deactivate the tamper switch 36, so that the sound-generating unit 14 produces an alarm sound.

On the other hand, when the body 21 is removed from the wall W together with the sound-generating unit 14, with the lid 32 left on the wall W, the housing 40 is axially moved relative to the plunger 44 away from the wall W under the influence of the coil spring 46 since the abutment 56 is disengaged from the housing 40, thereby bringing the contact element 48 out of engagement with the contact plates 50 and 52 to deactivate the tamper switch 36, so that the sound-generating unit 14 produces an alarm sound.

Thus, the alarm horn 20*a* can cope with the above-mentioned two modes of removal.

Figure 5:
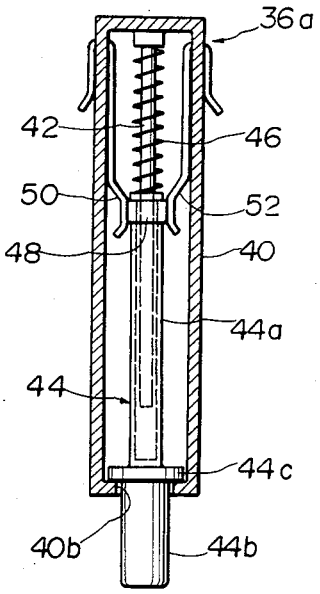
FIG. 5 is a view similar to FIG. 4 but showing a modified tamper switch.

According to another modified form of the invention, the tamper switch 36 of the normally open type may be replaced by a modified tamper switch 36*a* of the normally closed type shown in FIG. 5. With the tamper switch 36*a*, when the alarm horn is installed on the wall, a contact element 48 is held out of engagement with a pair of contact plates 50 and 52 to maintain the tamper switch 36*a* in its deactivated condition. Upon removal of the alarm horn from the wall, the contact element 48 is brought into contact with the contact plates 50 and 52 to cause the sound-generating unit 14 to produce an alarm sound through the control system.

What is claimed is:

1. An alarm horn which comprises:

(a) a one-piece molded body including (i) a casing portion having opposite open ends, (ii) a first horn disposed in said casing portion and having opposite open ends, said first horn being integrally connected to said casing portion at their one ends, (iii) a second horn of a generally cup-shape disposed in said first horn in spaced relation thereto, and (iv) connective means extending between said first and second horns to connect them together;

(b) a sound-generating unit disposed in said casing and fixedly connected to the other end of said first horn;

(c) a lid removably attached to the other end of said casing portion, said lid having a tubular portion extending generally perpendicularly to said lid and being disposed within said casing portion, said tubular portion having a pair of inner and outer open ends; and (d) switch means including (i) an elongated hollow housing received in said tubular portion for sliding movement therealong, said housing having an open outer end, (ii) a switch-operating plunger received in said housing for movement therealong between an operative position where said switch means is in its activated condition and an inoperative position where said switch means is in its deactivated condition, (iii) urging means mounted within said housing and acting between said housing and said plunger for urging said plunger into one of said inoperative and operative positions in such a manner that one end of said plunger is extended outwardly of said lid through said outer open ends of said housing and said tubular portion, and (iv) abutment means provided on an inner surface of said casing portion for abutment with the other end of said housing for limiting the axial movement of said housing inwardly of said lid.

2. An alarm horn according to claim 1, in which said connective means comprises a plurality of connective portions disposed around of said second horn in peripherally spaced relation to one another and extending between said first and second horns.

3. An alarm horn according to claim 1, in which said switch means comprising a first electrical contact mounted within said housing, and a second electrical contact carried by said plunger at the other end thereof, said second contact being engagable with said first contact, when said switch means is in its activated condition, and said second contact being held apart from said first contact when said switch means is in its deactivated condition.

4. An alarm horn according to claim 3, in which said second contact is normally held in contact with said first contact.

5. An alarm horn according to claim 3, in which said second contact is normally held apart from said first contact.

* * * * *